US005896602A

United States Patent [19]

Marblestone

[11] Patent Number: 5,896,602

[45] Date of Patent: Apr. 27, 1999

[54] ADJUSTABLE CHAIR FOR TRANSFER OF PATIENTS

[76] Inventor: Laura G. Marblestone, 812 Green Ridge Cir., Langhorne, Pa. 19053

[21] Appl. No.: 08/910,178

[22] Filed: Aug. 13, 1997

[51] Int. Cl.[6] ..... A61G 7/16

[52] U.S. Cl. ..... 5/81.1 R; 5/81.1 HS; 5/86.1

[58] Field of Search ..... 5/81.1 R, 83.1, 5/86.1, 81.1 C, 81.1 HS; 297/354.13

[56] References Cited

U.S. PATENT DOCUMENTS

| | | | |
|---|---|---|---|
| 2,607,050 | 8/1952 | Binshoff | 5/81.1 R |
| 3,293,668 | 12/1966 | Auer | 5/81.1 HS |
| 3,936,893 | 2/1976 | Anderson et al. | 5/86.1 |
| 3,967,328 | 7/1976 | Cox | 5/81.1 C |
| 4,761,841 | 8/1988 | Larsen | 5/81.1 C |
| 4,794,655 | 1/1989 | Ooka et al. | 5/81.1 C |
| 4,837,873 | 6/1989 | DiMatteo et al. | 5/81.1 C |
| 5,584,082 | 12/1996 | Crawford et al. | 5/86.1 |
| 5,651,149 | 7/1997 | Garman | 5/81.1 HS |

*Primary Examiner*—Michael F. Trettel
*Attorney, Agent, or Firm*—William H. Eilberg

[57] ABSTRACT

An adjustable chair facilitates the transfer of a patient from or to a hospital bed. The chair includes at least two segments which are movable relative to each other. The segments include rollers which are normally hidden from view, but which can be exposed when needed. To transfer the patient, the segments are moved so as to define a substantially flat surface. The chair is moved adjacent to the bed, and its height is adjusted so that the flat surface becomes level with the bed. A board is inserted between the patient and the bed. One then slides the board, with the patient on it, onto the flat surface. The board engages the rollers while sliding, thus making it possible for the transfer to be performed by only one person. When the board, with the patient, is located on the flat surface, the board can be removed, leaving the patient on the chair. The segments of the chair can then be arranged to form a normal chair configuration. The invention substantially reduces the number of personnel required to transfer a patient from a bed.

26 Claims, 5 Drawing Sheets

ADJUSTABLE CHAIR FOR TRANSFER OF PATIENTS

BACKGROUND OF THE INVENTION

This invention relates to the medical field, and provides an adjustable chair which facilitates the transfer of a patient from a hospital bed, or other bed.

When a patient in a hospital is unable to walk, it often becomes necessary to move the patient between a bed and a chair, or between a bed and a gurney or other transport device. Transferring a non-ambulatory patient from a bed typically requires the cooperation of several persons, who must lift the patient carefully, and deposit him or her onto the chair or other device. In practice, the nurse, or other hospital employee in charge of moving the patient, must enlist the help of other hospital personnel to perform this task. The procedure is inefficient because it requires that several persons simultaneously interrupt their other work to come to assist in the transport of one patient. When the procedure is performed repeatedly for many patients in a hospital on a single day, the disruptive effect is multiplied. And if the nurse tries to move the patient alone, the nurse risks a back injury due to the excessive strain required to lift the patient.

The present invention solves the problem of transferring a patient from a bed, by providing a method and apparatus which generally require only one person. The invention allows the patient to be transferred easily and comfortably between a bed and a lounge chair, and to be moved easily from one location to another.

SUMMARY OF THE INVENTION

The apparatus of the present invention includes an adjustable chair having a plurality of segments which are articulated and movable relative to each other, so that the chair can be unfolded to define a substantially flat surface. The chair has arm rests which can fold down to, or below, the level of the flat surface. The chair also includes a base portion which provides means for raising and lowering the chair. Thus, the chair, in its unfolded position, can be raised or lowered so that its surface becomes level with a bed.

The adjustable chair of the present invention includes a plurality of rollers, preferably disposed on at least two different segments of the chair. In the preferred embodiment, there is a set of rollers at each of two opposing positions, i.e. one set located on the segment which serves as a head rest and another set located on the segment which acts as a leg rest. The rollers are normally hidden behind pivotable enclosures. When the chair is unfolded to form the flat surface, and the enclosures are pivoted to expose the rollers, the result is a generally flat horizontal surface having upwardly extending sets of rollers at either end of the flat surface.

In the preferred embodiment, the chair also includes means for storing a generally flat board which is used in transferring the patient as explained below.

In using the chair of the present invention, one unfolds the chair to form the flat surface, and pivots the enclosures so as to expose the rollers. One moves the chair to a position adjacent the bed of the patient, and adjusts the height of the chair, if necessary, so that the flat surface becomes level with the bed. Then, one slides the board between the bed and the patient, so that the patient rests on the board. Next, one slides the board, with the patient, onto the chair, such that the board contacts at least one set of rollers, the sliding being done until the board becomes centered on the flat surface defined above. Next, one removes the board, leaving the patient on the flat surface. Finally, one adjusts the position of the segments of the chair, as desired. The result is that the patient is now positioned comfortably in the chair, with the transfer having been accomplished by one person only.

The base of the chair has lockable wheels, so the patient can be easily moved while sitting in the chair. Alternatively, the chair in its unfolded position, can serve as a gurney to transport a patient while lying down.

The present invention therefore has the primary object of facilitating the transfer of a patient between a bed and a chair.

The invention has the further object of providing a method and apparatus requiring only one person to transfer a non-ambulatory patient between a bed and a chair.

The invention has the further object of providing an adjustable chair which functions as a patient transfer device, and which also serves as a comfortable lounge chair for the patient.

The invention has the further object of providing an adjustable chair which also works as a gurney.

The invention has the further object of increasing the productivity of hospital personnel by reducing the number of persons needed to attend to a single patient.

The invention has the further object of facilitating home care of an elderly or infirm patient, by making it possible for an unassisted person to move the patient between a bed and a chair.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
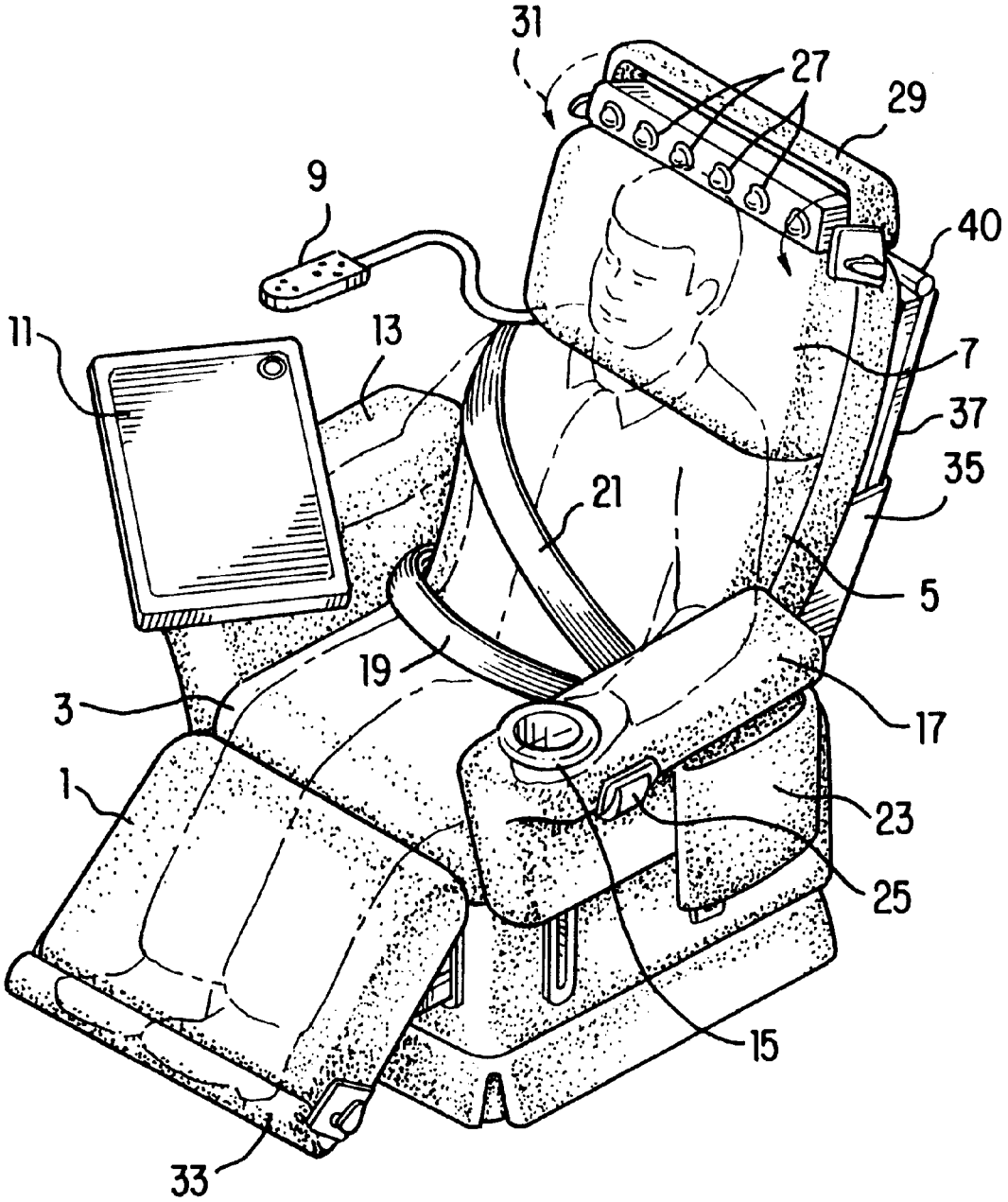
FIG. 1 provides a perspective view of the adjustable chair made according to the present invention.

FIG. 1 provides a perspective view of the adjustable chair of the present invention, showing a patient (in phantom) seated in the chair. The chair includes leg rest segment 1, seat segment 3, back segment 5, and head rest segment 7. These segments of the chair are articulated relative to each other, so that the chair can be folded or unfolded to assume many different possible positions. The precise arrangement and number of segments of the chair are not critical; more or fewer segments can be used. What is important is that the segments be relatively movable so that they can be unfolded, whereby the segments together define a substantially flat, horizontal surface, as will be described below.

The chair can be provided with various amenities to enhance the comfort of the patient. For example, control unit 9 is placed within easy reach of the patient, and allows the patient to adjust the position of the chair. The control unit is connected to one or more motors (not shown) which drive one or more of the segments of the chair. Tray 11 can be mounted to arm rest 13 of the chair, and can allow the patient to eat comfortably while seated in the chair. Drink holder 15 is mounted in the other arm rest 17 of the chair. Removable strap 19 and safety strap 21 can be used to prevent the patient from falling from the chair. Magazine pouch 23 provides convenient storage of reading material. The segments of the chair are preferably upholstered with washable, padded material. The amenities described above are not necessary to the operation of the invention, and some or all of them can be omitted, within the scope of the invention.

Release lever 25 allows the arm rests to pivot downward and away from the chair. Separate levers can be provided for each arm rest.

The chair also includes a plurality of rollers 27. The rollers 27 are normally hidden by pivotable enclosure 29. The enclosure can pivot in the direction indicated by arrow 31 to cover the rollers. To expose the rollers, one pivots the enclosure in a direction opposite to that of the arrow. The enclosure is preferably formed of a material which matches the appearance of the material used to form the head rest segment (and, preferably, the other segments), so that the presence of the rollers is not readily apparent when the chair is in normal use.

A similar set of rollers is preferably provided in the leg rest segment. This other set of rollers is hidden from view in FIG. 1, as the rollers are covered by enclosure 33, which is similar to enclosure 29.

While the positions of the rollers can be varied, within the scope of the invention, it is preferred that the rollers be positioned such that when the segments of the chair are unfolded to form the substantially flat surface, the rollers become located at opposite ends of that surface. FIGS. 2–5 illustrate the rollers disposed at opposite ends of the substantially flat surface.

Attached to the back segment is a pocket 35 in which there is stored a board 37 which is used in transferring a patient to or from a bed, as will be explained below. In the embodiment shown, the board has two segments, and is foldable about a hinge 40 so that it can be conveniently stored in its folded position. The hinge could be constructed so that it locks in a given position, to prevent the board from folding while the patient is lying upon it, but the exact structure of the hinge can be varied, and the invention is not limited according to a particular hinge structure.

Figure 2:
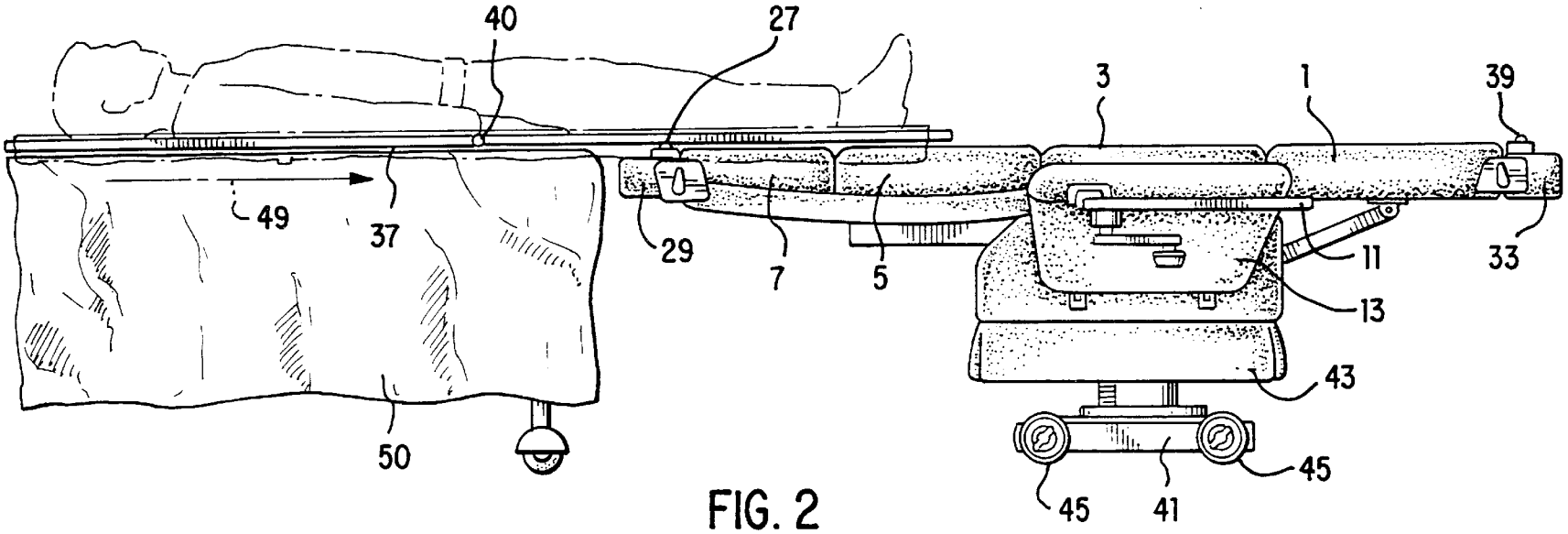
FIG. 2 provides a side view showing the chair of the present invention in its unfolded position, and showing a patient being transferred onto the chair from a bed.

FIG. 2 provides a side view of the chair of the present invention, when it has been unfolded to assume its substantially flat position, and moved alongside a bed. As shown in FIG. 2, head rest segment 7, back segment 5, seat segment 3, and leg rest segment 1 together define a substantially flat, horizontal surface. Enclosures 29 and 33 have been pivoted to their open positions to expose rollers 27 and 39. Arm rest 13 is shown in its "down" position. Note that the arm rest is positioned sufficiently downward so that it is below the flat surface defined by the segments, and does not interfere with that surface. The tray 11 is shown in its stored position. FIG. 2 also shows base 41 which can provide manual, electric, or hydraulic lifting means (not shown) to raise and lower the chair. Flaps 43 hide the lifting mechanism from view. Wheels 45 allow the chair to be easily moved from one location to another. In FIG. 2, the chair has been moved alongside bed 50. In the preferred embodiment, the wheels can be locked in a given position, so that the chair will not move when the patient is being transferred.

The method of transferring a patient from a bed, according to the present invention, will now be described. First, one prepares the chair by lowering the arm rests, placing the tray in its stored position, and unfolding the segments of the chair so that they define a substantially flat, horizontal surface, as shown in FIG. 2. One also pivots enclosures 29 and 33 to expose the rollers. One moves the unfolded chair to the vicinity of the bed 50, and adjusts the height of the unfolded chair, as indicated by arrows 47 in FIG. 3, so that the flat surface is substantially level with the bed.

Next, one removes the board 37 from its pocket, and unfolds the board so that it is flat. One slides the board under the patient (preferably between the bed and a blanket), so that the patient rests upon the board, and is centered thereon. Use of the blanket between the board and the patient reduces friction, and makes the process more comfortable for the patient, and easier for the person moving the patient.

Figure 5:
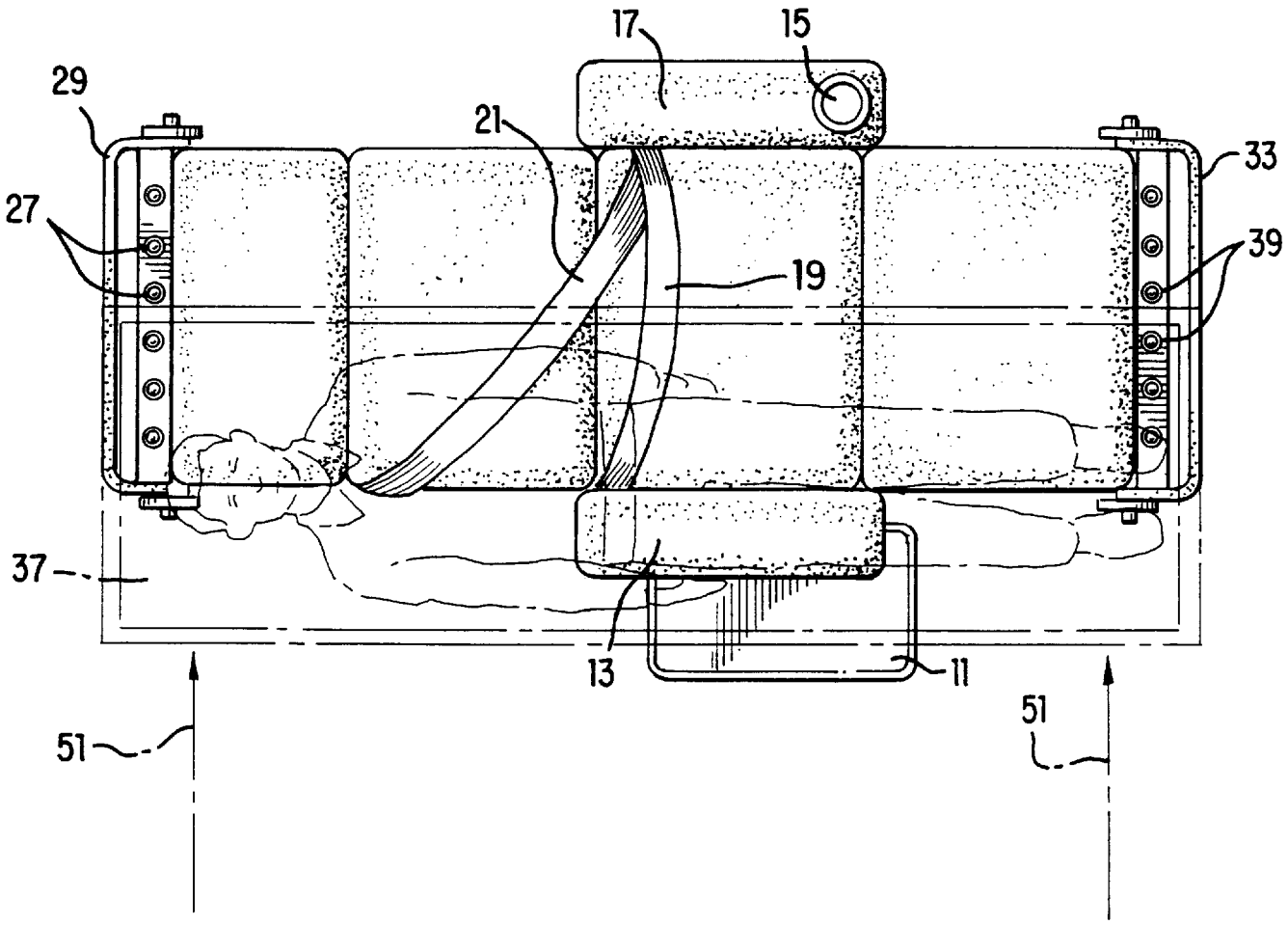
FIG. 5 provides a plan view of the chair of the present invention, showing the preferred method of transferring a patient to the chair.

Next, one slides the board, with the patient lying upon it, onto the flat surface of the chair. This sliding step can be performed longitudinally, as shown in FIG. 2, wherein the board slides in the direction indicated by arrow 49. But the preferred means of sliding is shown in FIG. 5, wherein the board is moved transversely relative to the chair, as indicated by arrows 51. In the embodiment of FIG. 5, the chair is positioned side by side with the bed (the bed is omitted from FIG. 5, for the sake of clarity of illustration). Thus, in the embodiment of FIG. 5, the board is moved transversely relative to both the bed and the chair. As shown in FIG. 5, both ends of the board touch a set of rollers, disposed at either end of the flat surface defined by the chair. Thus, both sets of rollers simultaneously reduce the friction associated with the sliding of the board. By contrast, in the embodiment of FIG. 2, only one set of rollers contacts the board, during almost the entire sliding operation. While the arrangement of FIG. 5 is preferred, both arrangements are within the scope of the present invention. In both cases, the board carrying the patient contacts at least one set of rollers, and the friction associated with the sliding of the board is thereby greatly reduced.

Figure 3:
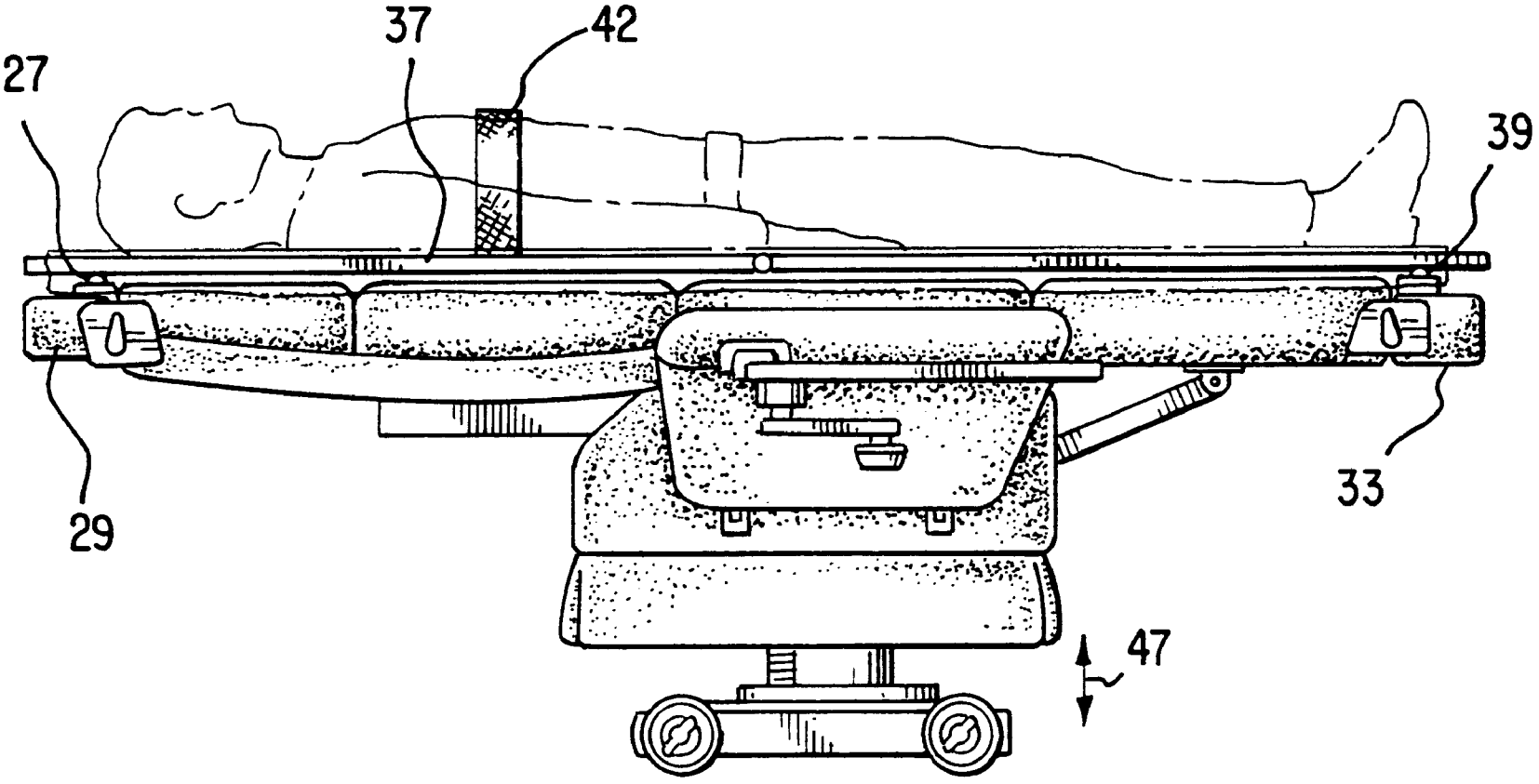
FIG. 3 provides a side view showing the chair of the present invention, and showing the patient resting on the board used to transfer the patient from a bed.
Figure 4:
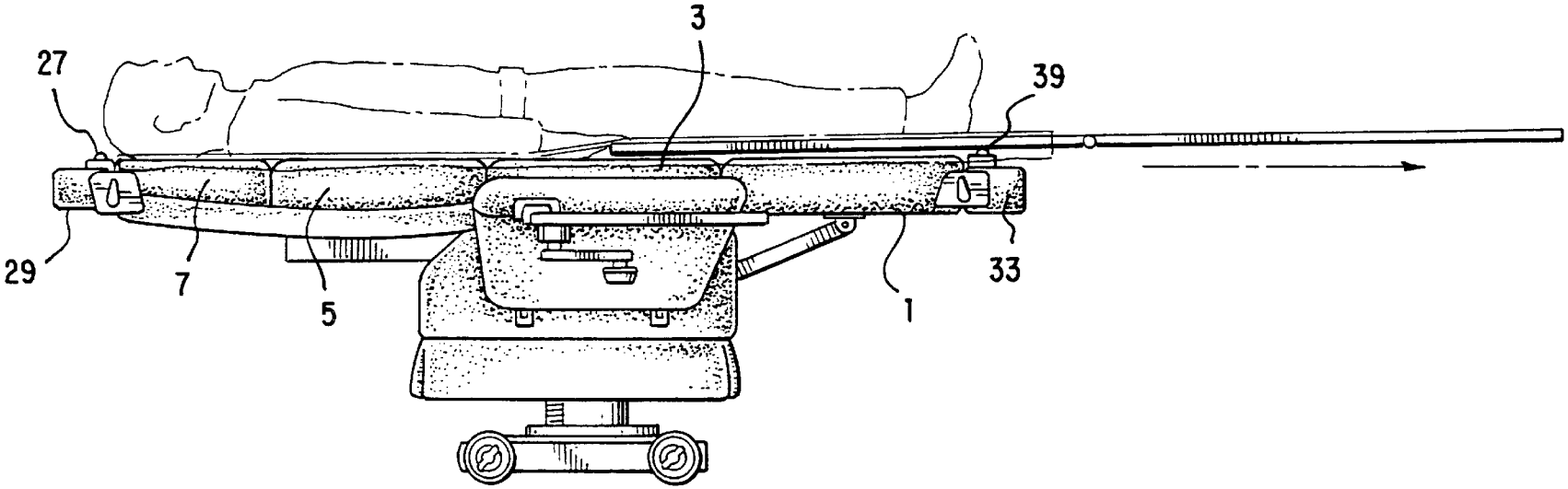
FIG. 4 provides a side view, similar to FIG. 3, showing the board being removed, while the patient remains on the unfolded chair.

When the board has been fully moved onto the chair, the result is as shown in FIG. 3. The patient is now lying on the board 37, which rests on the chair, and which contacts both sets of rollers. Note that, while in this position, the chair could be used as a gurney to move the patient from one location to another, while the patient is still lying down. Next, one removes the board, by sliding it out from under the patient, as shown in FIG. 4. FIG. 4 shows the board being removed in the longitudinal direction. The board could also be removed in the transverse direction, i.e. in a direction comparable to that indicated in FIG. 5. The board could also be tilted upward to facilitate its removal from the patient.

Finally, one adjusts the chair to make it conform to a normal configuration of a chair, such as is shown in FIG. 1. Depending on the condition of the patient, one may also perform the preliminary step of engaging the straps to prevent the patient from falling while the segments of the chair are moved. The arm rests are restored to their normal position, and the tray can be adjusted as necessary. The board is folded and stored in its pocket.

To return the patient to the bed, from the chair, the process steps described above can simply be reversed.

In transferring a patient between a bed and the chair, the arm rests are moved such that they are positioned below the flat surface defined by the chair. In this way, the arm rests do not interfere with the movement of the board. However, if the chair is to be used as a gurney, the arm rests can be moved up, partly or fully, after the patient is positioned on the flat surface defined by the opened chair, to help prevent the patient from falling off.

The chair can also be constructed such that it rises so as to help the patient stand up. Lounge chairs which rise in this manner are known in the art, and can be used in the practice of the present invention.

The board can be equipped with one or more straps, similar to those formed on the chair, to prevent the patient from falling from the board while it is being moved. FIG. 3 shows strap 42 attached to the board. The strap is optional, and the invention can be practiced without it. For clarity of illustration, only FIG. 3 shows such a strap.

The board is preferably formed of a stiff plastic material which is strong enough to use in the method described above, but sufficiently flexible to be comfortable to the patient, and to be handled by hospital personnel. The invention is not limited, however, by the material used to make the board, or by its configuration, or by its manner of attachment to the chair. Thus, the board could be made of a hard material, and could be provided in a non-foldable condition. While it is preferred that the board be stored on or in the chair, so that it is readily available when needed, such an arrangement is not absolutely necessary to the practice of the invention. It is possible, for example, to store the board in a location different from that of the chair, such as in a closet, and to retrieve the board only when it is necessary to transfer a patient. Such alternatives are within the scope of the invention.

In another alternative, the rollers could be connected to a source of motive power, such as an electric motor (not shown), to assist in the sliding of the patient onto or away from the chair.

Instead of rollers, the chair could have an endless belt, similar to a conveyor belt, positioned to assist in sliding the board onto the chair. In still another alternative, the rollers could be replaced by a rotatable cylinder which performs the same function as the rollers. Other alternatives to the rollers are possible. In its most general form, the invention therefore comprises an adjustable chair having a means for reducing friction, the friction reducing means being disposed on the side of the chair which faces upward when the chair is unfolded to its flat position. The rollers are the preferred friction reducing means.

The present invention therefore makes it possible for an unassisted person to move a patient between a bed and a chair. The invention therefore substantially reduces the demands placed on hospital staff. Also, by reducing the physical effort required to move a patient, the invention reduces the likelihood of back injuries to hospital staff, and the attendant disability claims. For this reason, use of the invention can be expected to reduce the cost of workers compensation insurance.

The invention is not limited to use in hospitals, but can also be used in other institutions such as nursing homes. Moreover, the invention is especially useful in private homes where an elderly or infirm person resides, and where backup personnel are not available.

The invention can be modified in further ways. For example, the exact configuration of the chair can be varied. The number of segments can be changed, within the scope of the invention, the only limitation being that the segments unfold to define a substantially flat surface. The positions of the sets of rollers can be changed; it is possible to place rollers at other locations on the segments of the chair, and/or to add more rollers to those that are shown. These and other modifications, which will be apparent to those skilled in the art, should be considered within the spirit and scope of the following claims.

What is claimed is:

1. Apparatus for facilitating the transfer of a patient between a bed and a chair, the apparatus comprising:

a) an adjustable chair, the chair having a plurality of articulated segments, the segments being movable to define a substantially flat surface, said surface defining an unobstructed plane, and b) friction reducing means disposed on at least one of said segments, wherein the friction reducing means protrudes beyond said plane in a direction away from said segments.

2. The apparatus of claim 1, wherein the friction reducing means comprises a plurality of rollers.

3. The apparatus of claim 2, wherein there are two sets of rollers, a first set of rollers being located on one of said segments and a second set of rollers being located on another of said segments.

4. The apparatus of claim 3, wherein said sets of rollers are positioned such that when the segments are moved to define said substantially flat surface, the rollers become located at opposite ends of said substantially flat surface.

5. The apparatus of claim 3, wherein the chair includes enclosures which are pivotable, wherein pivoting of said enclosures alternately hides and exposes the rollers.

6. The apparatus of claim 1, wherein the chair includes means for adjusting a height of the chair, wherein the height adjusting means comprises means for making the flat surface level with a bed.

7. The apparatus of claim 1, wherein the chair includes means for storing a generally flat board.

8. The apparatus of claim 7, wherein the board includes a strap attached thereto.

9. The apparatus of claim 7, wherein the storing means comprises a pocket attached to one of said segments.

10. The apparatus of claim 1, wherein the segments include a seat segment, a leg rest segment, a back segment, and a head rest segment.

11. The apparatus of claim 1, wherein the chair includes arm rests, and wherein the chair includes means for adjusting a position of the arm rests.

12. A chair for facilitating transfer of a patient from and to a bed, the chair comprising:

a) at least two articulated segments, the segments being movable from a folded position to a position wherein the segments define a substantially flat surface, said surface defining an unobstructed plane, b) at least one means for reducing friction located on each of said segments, wherein the friction reducing means protrudes beyond said plane in a direction away from said segments, and c) means for alternately hiding and exposing said at least one means for reducing friction.

13. The chair of claim 12, wherein the means for reducing friction comprises a roller.

14. The chair of claim 12, further comprising means for storing a generally flat board.

15. The chair of claim 14, wherein the storing means comprises a pocket attached to one of said segments.

16. A method of transferring a patient between a bed and a chair, the method comprising the steps of:

a) providing an adjustable chair having a plurality of articulated segments, the segments being capable of being moved to a position wherein the segments define a substantially flat surface, the chair including at least one means for reducing friction disposed on at least one of said segments, b) arranging the segments to define a substantially flat surface, c) moving the chair to a position adjacent a bed containing a patient, d) sliding a board between the bed and the patient such that the patient is positioned on the board, e) sliding the board, with the patient thereon, onto the flat surface, such that the board contacts said at least one means for reducing friction while sliding, so that the board and the patient are transferred to the flat surface, f) removing the board so as to leave the patient on the flat surface, and g) moving the segments so as to configure the chair in a desired position, with the patient seated thereon.

17. The method of claim 16, wherein the surface has a length and a width, and wherein step (e) is performed by sliding the board along a path parallel to the length of the surface.

18. The method of claim 16, wherein the surface has a length and a width, and wherein step (e) is performed by sliding the board along a path parallel to the width of the surface.

19. A method of moving a patient between a bed and a chair, the method comprising the steps of:

a) arranging a segmented chair to define a substantially flat surface, b) moving the chair to a vicinity of a bed containing a patient to be moved, and adjusting a height of the chair such that the chair becomes level with the bed, c) placing a board between the patient and the bed, d) sliding the board, with the patient, onto the surface, wherein the sliding step is performed by contacting the board with means for reducing friction located on said substantially flat surface, and e) removing the board, leaving the patient on the chair.

20. The method of claim 19, further comprising the step of arranging segments of the chair to form a normal chair configuration.

21. The method of claim 19, wherein step (c) is preceded by the step of removing the board from a pocket attached to the chair, and wherein step (e) is followed by the step of replacing the board in said pocket.

22. The method of claim 19, wherein step (d) is preceded by the step of securing the patient to the board by fastening at least one strap, attached to the board, around the patient.

23. Apparatus for facilitating the transfer of a patient between a bed and a chair, the apparatus comprising:

a) an adjustable chair, the chair having a plurality of articulated segments, the segments being movable to define a substantially flat surf ace, and b) friction reducing means disposed on at least one of said segments, wherein the friction reducing means comprises a plurality of rollers, wherein there are two sets of rollers, a first set of rollers being located on one of said segments and a second set of rollers being located on another of said segments, and wherein the chair includes enclosures which are pivotable, wherein pivoting of said enclosures alternately hides and exposes the rollers.

24. Apparatus for facilitating the transfer of a patient between a bed and a chair, the apparatus comprising:

a) an adjustable chair, the chair having a plurality of articulated segments, the segments being movable to define a substantially flat surface, and b) friction reducing means disposed on at least one of said segments, wherein the chair includes means for storing a generally flat board, and wherein the board includes a strap attached thereto.

25. The apparatus of claim 24, wherein the storing means comprises a pocket attached to one of said segments.

26. A chair for facilitating transfer of a patient from and to a bed, the chair comprising:

a) at least two articulated segments, the segments being movable from a folded position to a position wherein the segments define a substantially flat surface, b) at least one means for reducing friction located on each of said segments, and c) means for alternately hiding and exposing said at least one means for reducing friction, further comprising means for storing a generally flat board, wherein the storing means comprises a pocket attached to one of said segments.

* * * * *